US008671890B2

(12) United States Patent
Davidson

(10) Patent No.: US 8,671,890 B2
(45) Date of Patent: Mar. 18, 2014

(54) PIPE ASSEMBLY

(75) Inventor: Ian S. Davidson, Isle of Man (GB)

(73) Assignee: Diamond Power International, Inc., Lancaster, OH (US)

( * ) Notice: Subject to any disclaimer, the term of this patent is extended or adjusted under 35 U.S.C. 154(b) by 1154 days.

(21) Appl. No.: 11/912,720

(22) PCT Filed: Jul. 25, 2005

(86) PCT No.: PCT/GB2005/002898

§ 371 (c)(1),
(2), (4) Date: Mar. 28, 2008

(87) PCT Pub. No.: WO2006/114559

PCT Pub. Date: Nov. 2, 2006

(65) Prior Publication Data

US 2009/0120383 A1 May 14, 2009

(30) Foreign Application Priority Data

Apr. 28, 2005 (GB) ..... 0508584.0

(51) Int. Cl.
*F22B 37/06* (2006.01)

(52) U.S. Cl.
USPC ..... 122/511; 138/177; 73/861.95

(58) Field of Classification Search
USPC ..... 122/379, 392, 511, DIG. 13; 165/134.1, 165/177, 178; 374/147; 138/177, DIG. 8, 138/DIG. 11, 178; 73/861.95
See application file for complete search history.

(56) References Cited

U.S. PATENT DOCUMENTS

| | | | | | |
|---|---|---|---|---|---|
| 3,276,437 | A | * | 10/1966 | Jonakin et al. | 122/392 |
| 4,408,568 | A | | 10/1983 | Wynnyckyj et al. | |
| 4,488,516 | A | * | 12/1984 | Bueters et al. | 122/379 |
| 4,527,908 | A | * | 7/1985 | Arisi | 374/147 |
| 4,671,675 | A | * | 6/1987 | Arisi et al. | 374/147 |
| 4,722,610 | A | * | 2/1988 | Levert et al. | 374/43 |
| 4,802,446 | A | | 2/1989 | Triggs et al. | |
| 5,382,093 | A | * | 1/1995 | Dutcher | 374/208 |
| 5,385,202 | A | * | 1/1995 | Drosdziok et al. | 165/11.1 |
| 5,571,974 | A | * | 11/1996 | Nauful | 73/861.27 |
| 6,848,373 | B2 | * | 2/2005 | Breen et al. | 110/341 |
| 7,168,334 | B1 | * | 1/2007 | Drott | 73/866.5 |
| 7,249,885 | B2 | * | 7/2007 | Van Den Ende et al. | 374/147 |
| 8,366,316 | B2 | * | 2/2013 | Kamen et al. | 374/44 |

(Continued)

FOREIGN PATENT DOCUMENTS

| | | |
|---|---|---|
| DE | 10248312 | 4/2004 |
| GB | 2271440 | 4/1994 |
| JP | 2002243107 | 8/2002 |

OTHER PUBLICATIONS

International Search Report No. PCT/GB2005/002698, dated Jan. 10, 2006.

(Continued)

*Primary Examiner* — Gregory A Wilson
(74) *Attorney, Agent, or Firm* — Brinks Gilson & Lione

(57) ABSTRACT

The invention relates to a pipe assembly (102) for use in a boiler. The pipe assembly (102) comprises a pipe (104) having an outer wall (106) adapted for heat exchange. The pipe (104) having heat sensing means (116) located in a recess section of the outer wall (106) thereof, wherein an internal bore (108) of the pipe (104) has a substantially constant cross section in the region of the heat sensing means (116).

22 Claims, 2 Drawing Sheets

(56) References Cited

U.S. PATENT DOCUMENTS

| | | | | |
|---|---|---|---|---|
| 8,491,184 | B2 * | 7/2013 | Kamen et al. | 374/44 |
| 2002/0064206 | A1 * | 5/2002 | Gysling et al. | 374/147 |
| 2002/0166595 | A1 * | 11/2002 | Lindsay | 138/153 |
| 2004/0045369 | A1 * | 3/2004 | Bitto et al. | 73/861.18 |

OTHER PUBLICATIONS

International Preliminary Report on Patentability issued in corresponding International Application No. PCT/GB2005/002898 on Oct. 30, 2007.

* cited by examiner

PIPE ASSEMBLY

RELATED APPLICATIONS

This application is a National Stage application of PCT/GB2005/002898, filed Jul. 25, 2005, which claims benefit of GB 0508584.0, filed Apr. 20, 2005, disclosure of which are incorporated herein by reference.

The present invention relates to a pipe assembly, particularly to a pipe assembly for use in a boiler.

Conventional plant or process boilers convert water into steam by the transfer of heat from burning fuel, e.g. fossil fuel, biomass or other fuels to water. The water passes through pipes which form the surface of a combustion chamber in which the fuel is burnt. Transfer of heat from the burning fuel to the pipes is almost entirely by radiation. Heat is absorbed at outer wall surfaces of the pipes and conducts through the material of the pipe wall to an inner surface of the pipe wall, the inner surface of the pipe wall being in contact with the water/steam.

A long standing problem with such boilers is that ash and slag from combustion of the fossil fuel accumulates on the outer surfaces of the pipe walls. Since such ash and slag has a low thermal conductivity, heat transfer from the combustion chamber to the inner surfaces of the pipe walls is severely reduced.

Such poor heat transfer characteristics can seriously affect the economics of a boiler operation. In a typical boiler, even a small percentage loss in efficiency due to ash and slag build-up can cause a loss in efficiency costing thousands of pounds.

The formation and properties of the ash and slag deposits are dependent upon boiler conditions, the mineral content of the fuel, the fuel/air ratio, the impingement of flames on the furnace walls, and variation in ash mineralisation.

Conventionally the slag and ash is removed at periodic intervals from the outer surfaces of the pipe walls in the combustion chamber wall. Early removal methods required complete shut down of the boiler and removal of the slag and ash by hand. Later methods included introducing a cleaning fluid e.g. air or steam, through a hand hole in the boiler e.g. by a high pressure hose to remove the slag by hand.

A subsequent method has been to fix a movable cleaning device within a boiler which removes slag during a cleaning cycle conducted periodically. Such cleaning devices are commonly called soot blowers. Modern boilers include several soot blowers which can be operated automatically without shut down of the boiler. However, such soot blowing apparatus has a disadvantage that operation of the soot blowers causes a temporary reduction in steam making capacity due to the cooling effect of the soot blowing agent on the combustion process and pipe surfaces. Furthermore, when a boiler is operating in a low steam demand condition, and the boiler firing rate is at a low level, the combustion may be extinguished by a quenching effect of the soot blowing.

There is therefore a need to be able to measure the amount of soot build up in order to monitor the heat being transferred through the pipe walls to the water/steam.

One solution known in the art is described in GB 2,271,440 which provides a boiler pipe assembly having four thermocouples embedded into the wall of the pipe. In order to keep an exterior surface of the pipe in this region the same as the rest of the pipe and thereby avoid the preferential build up of soot, the pipe is dented to allow the thermocouples to be inserted, then rebuilt to its original profile by utilising a thermally conductive filler material. This system, while very effective, suffers from the problem that the water/steam flow through the pipe can be restricted, especially in tubes with smaller internal bore sizes, at the point where the thermocouples are inserted because of the indentation made in the pipe. Such a restriction of flow can lead to a pressure drop which can cause flow restriction leading to over heating and possible rupture of the pipe. Furthermore, since the disclosure of GB 2,271,440, the trend with new boiler systems is to incorporate pipes of a smaller internal bore which serves to amplify the above mentioned problem.

It is an object of aspects of the present invention to attempt to overcome at least one of the above or other problems.

According to a first aspect of the present invention there is provided a pipe assembly for use in a boiler, the pipe assembly comprising a pipe having an outer wall adapted for heat exchange, the pipe having heat sensing means located in a recess section of the outer wall thereof, wherein an internal bore of the pipe has a substantially constant cross section in the region of the heat sensing means.

Advantageously, the internal bore of the pipe has a substantially constant cross section in the region of the heat sensing means thereby alleviating the problems associated with irregular fluid flow through the internal bore.

Preferably, the pipe comprises a diagnostic portion. Preferably, the diagnostic portion incorporates the recess in the outer wall of the pipe and the heat sensing means. Preferably, internal bore comprises a kink at the diagnostic portion. Preferably, the internal bore comprises an offset at the diagnostic portion. Preferably, at the diagnostic portion, a longitudinal axis of the internal bore curves away from a generally straight longitudinal axis, before curving back to resume its original straight longitudinal axis.

Preferably, the pipe comprises a pre-diagnostic portion situated at a first side of the diagnostic portion and a post-diagnostic portion situated at a second side of the diagnostic portion. Preferably, the longitudinal axis of the internal bore at the pre-diagnostic portion and the post-diagnostic portion are substantially co-linear. Preferably, a longitudinal axis of the internal bore at the diagnostic portion is generally actuate. Preferably, a longitudinal axis of the internal bore comprises a dip at the diagnostic portion. Preferably, the region of the heat sensing means incorporates the pre-diagnostic portion, the diagnostic portion and the post-diagnostic portion.

By the term "the region of the heat sensing means" it is meant an area of the pipe where the heat sensing means is located and an area immediately at either side thereof. Preferably, the region of the heat sensing means incorporates a section of the pipe incorporating the heat sensing means and a one meter section of the pipe at either side thereof. Preferably, the region of the heat sensing means incorporates a section of the pipe incorporating the heat sensing means and a fifty centimeter section of the pipe at either side thereof. Preferably, the region of the heat sensing means incorporates a section of the pipe incorporating the heat sensing means and a ten centimeter section of the pipe at either side thereof.

Preferably, the pipe comprises a kink at the diagnostic portion. Preferably, the pipe comprises an offset at the diagnostic portion. Preferably, at the diagnostic portion a longitudinal axis of the pipe curves away from a generally straight longitudinal axis, before curving back to resume its original straight longitudinal axis.

Preferably, the recess section is filled using a filler material. Preferably, the filler material comprises a thermally conductive filler material.

Preferably, the recess section is filled such that an outer surface of the pipe is restored to a profile before the recess was formed. Preferably, the recess section is filled such that the outer surface is restored to match an outer profile of the rest of the pipe surrounding the recess section.

Preferably, the internal bore is substantially circular in cross section. Preferably, the internal bore extends generally along a longitudinal axis of the pipe. Preferably, the internal bore is adapted to accommodate a fluid therein. Preferably, the internal bore is adapted to allow a fluid to flow therethrough. Preferably, the fluid is water, steam or supercritical water/steam. By the term supercritical water/steam it is meant water under such temperature and pressure conditions that it is beyond its critical point. Preferably, the internal bore is not in fluid communication with an exterior of the pipe.

Preferably, in use, at least a portion of the outer wall of the pipe is adapted to allow heat to transfer between a combustion chamber and the internal channel.

Preferably, the pipe assembly further comprises joining means adapted to allow the pipe assembly to be joined to other pipe assemblies. Alternatively, the pipe assembly may be adapted to be attached to a backing sheet, to which backing sheet may be attached a number of other pipes. Preferably, the joining means comprise at least one joining rib, which joining rib preferably extends radially outwardly from an outer surface of the pipe. Preferably, the joining means comprise at least two joining ribs.

Preferably, the at least two joining ribs extend radially outwardly from opposite sides of the pipe.

Preferably, the heat sensing means comprises at least one thermocouple. Preferably, the heat sensing means comprises at least two thermocouples. Preferably, at least a second of the at least two thermocouples is situated toward an outer surface of the pipe assembly. Preferably, at least a first of the at least two thermocouples is situated toward an inner surface of the outer wall. Preferably, the at least two thermocouples occupy different positions relative to the internal bore, preferably at least a first of which being closer to the internal bore than at least a second. Preferably, the at least two thermocouples are adapted to measure heat transfer through the outer wall of the pipe. Preferably, the heat sensing means comprises at least four thermocouples. Preferably, the heat sensing means is adapted to give a continuous output. Preferably, the pipe assembly further comprises trunking means.

Preferably, the trunking means is adapted to accommodate wires of the heat sensing means. Preferably, the trunking means comprises a tube extending radially from an exterior surface of the pipe. Preferably the tube comprises an internal bore extending therethrough which internal bore is preferably circular in cross section.

Preferably, the pipe assembly further comprises attachment means adapted to allow the pipe assembly to be attached to a surface. Preferably, the attachment means comprise a flange attached to the tube, preferably at an end of the tube distal to the pipe.

According to a second aspect of the present invention there is provided a method of monitoring heat transfer across a heat exchange surface of a pipe assembly, the method comprising the step of;

i) monitoring an output from heat sensing means which heat sensing means are located in a recess section of an outer wall of a pipe, the pipe comprising an internal bore extending therethrough, wherein the internal bore has a substantially constant cross section in the region of the heat sensing means.

According to a third aspect of the present invention there is provided a method of manufacturing a pipe assembly comprising the steps of;

i) bending a pipe having an internal bore extending therethrough to create a recess section in an outer wall thereof, while maintaining a substantially constant cross section of the internal bore;

ii) locating heat sensing means in the recess section; and iii) using a filler material to fill the recess section.

Preferably, the pipe is bent using a hydraulic press. Preferably, the pipe is bent by being cold formed.

According to a fourth aspect of the present invention there is provided a diagnostic boiler pipe assembly, the assembly comprising a pipe having an outer wall adapted for heat exchange, the pipe having heat sensing means located in a recess section of the outer wall thereof, wherein an internal bore of the pipe has a substantially constant cross section in the region of the sensing means.

According to a fifth aspect of the present invention there is provided a boiler comprising a pipe assembly, which pipe assembly comprises a pipe having an outer wall adapted for heat exchange, the pipe having heat sensing means located in a recess section of the outer wall thereof, wherein an internal bore of the pipe has a substantially constant cross section in the region of the sensing means.

All of the features disclosed herein may be combined with any of the above aspects in any combination.

For a better understanding of the invention, and to show how embodiments of the same may be carried into effect, reference will now be made, by way of example, to the accompanying diagrammatic drawings in which.

Figure 1:
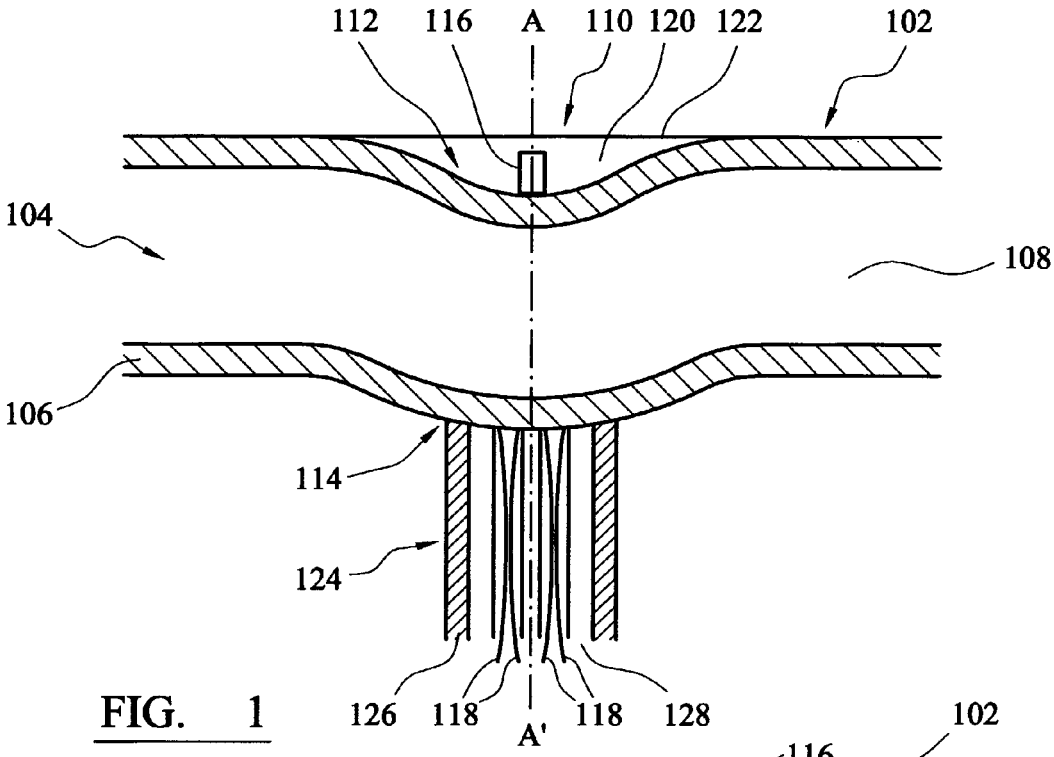
FIG. 1 shows a cross sectional side view through a pipe assembly.

Referring to FIG. 1 there is shown a pipe assembly 102 having a pipe 104 which has an outer wall 106 and a circular internal bore 108 extending therethrough. The pipe 104 comprises a heat sensing region 110 where the pipe 104 comprises a kink along a longitudinal axis thereof. In other words, following a path through the pipe 104, at the sensor region 110 the internal bore 108 gently bends downwards away from its previous longitudinal axis before gently bending back upwards and substantially returning to its previous longitudinal axis. All the while, the cross section of the internal bore 108 remains substantially constant. Commonly, in engineering terminology, such a feature of a pipe is known as a bend or offset. Such a feature leaves a concave area 112 (a recess section) along one side of the pipe 104 and a convex area 114 along an opposite side of the pipe 104. In the concave area 112 are four thermocouples 116 which have a number of wires 118 which extend around the circumference of the pipe 104 to the convex area 114. The concave area 112 is filled with a thermally conductive filler material 120 such that an upper surface 122 of the heat sensing region 110 maintains the profile of an upper surface of the pipe 104 outside the heat sensing region 110. In this manner, the filler material 120 effectively removes the concave region 112 from the upper surface of the pipe 104 leaving a continuous surface contour. Also, the thermocouples 116 are thus embedded within the filler material 120. For further information on the manner in which the thermocouples are fitted to the pipe assembly and monitored, please refer to GB 2,271,440.

The convex area 114 has a further pipe 124 extending perpendicularly away therefrom. The pipe 124 comprises an outer wall 126 and an internal bore 128, being circular in cross section, which extends therethrough. The wires 118 extend from the thermocouples 116 circumferentially around the pipe 104 (as discussed above) and into the pipe 124. The wires 118 have sufficient length such that they extend through the pipe 124 and protrude therefrom at end distal to the pipe 104.

Figure 2:
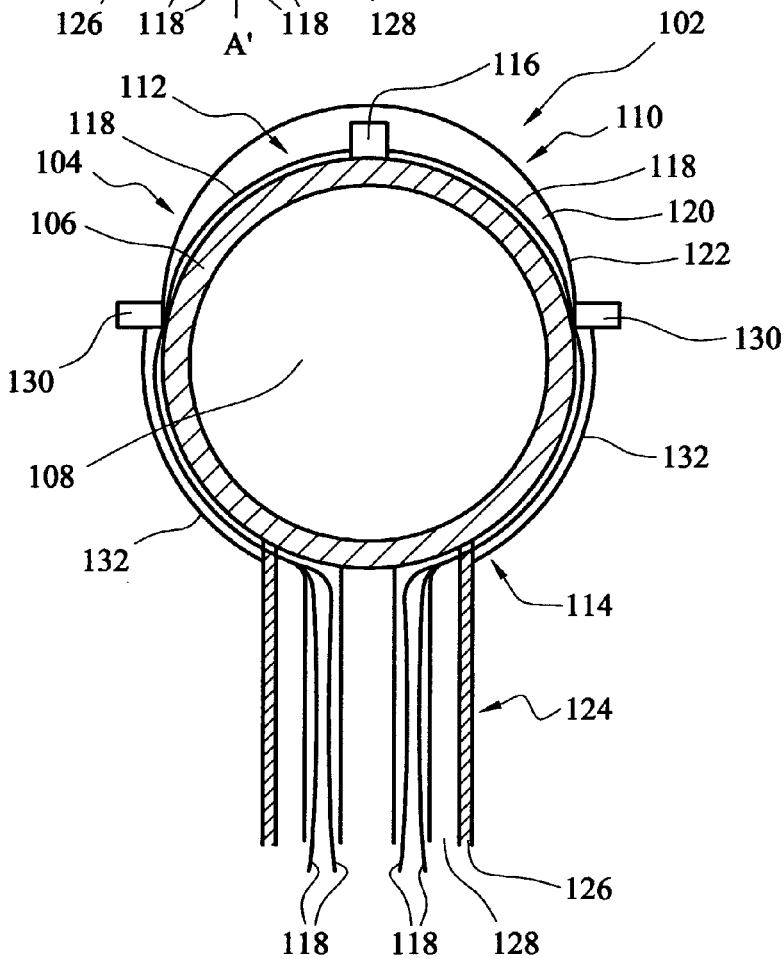
FIG. 2 shows a cross sectional front view through pipe assembly.

A cross sectional view through the pipe assembly 102 taken along the line A-A' of FIG. 1 is shown in FIG. 2 and more clearly demonstrates the circular internal bore 108 of the pipe 104. Also shown are ribs 130 extending radially outwardly from opposite sides of the pipe 104 at either side of the concave region 112. The ribs 130 extend longitudinally along the length of the pipe 104. Extending cicumferentially from an underside of the ribs 130 to the internal bore 128 of the pipe 124 are a pair of arms 132. The function of the arms 132 is firstly to provide a further fixture point between the pipe 104 and the pipe 124 thus increasing the structural integrity of the assembly and secondly that the wires 118 pass between an internal surface of the arms 132 and an external surface of the wall 106 of the pipe 104 thus providing protection to the wires 118.

Figure 3:
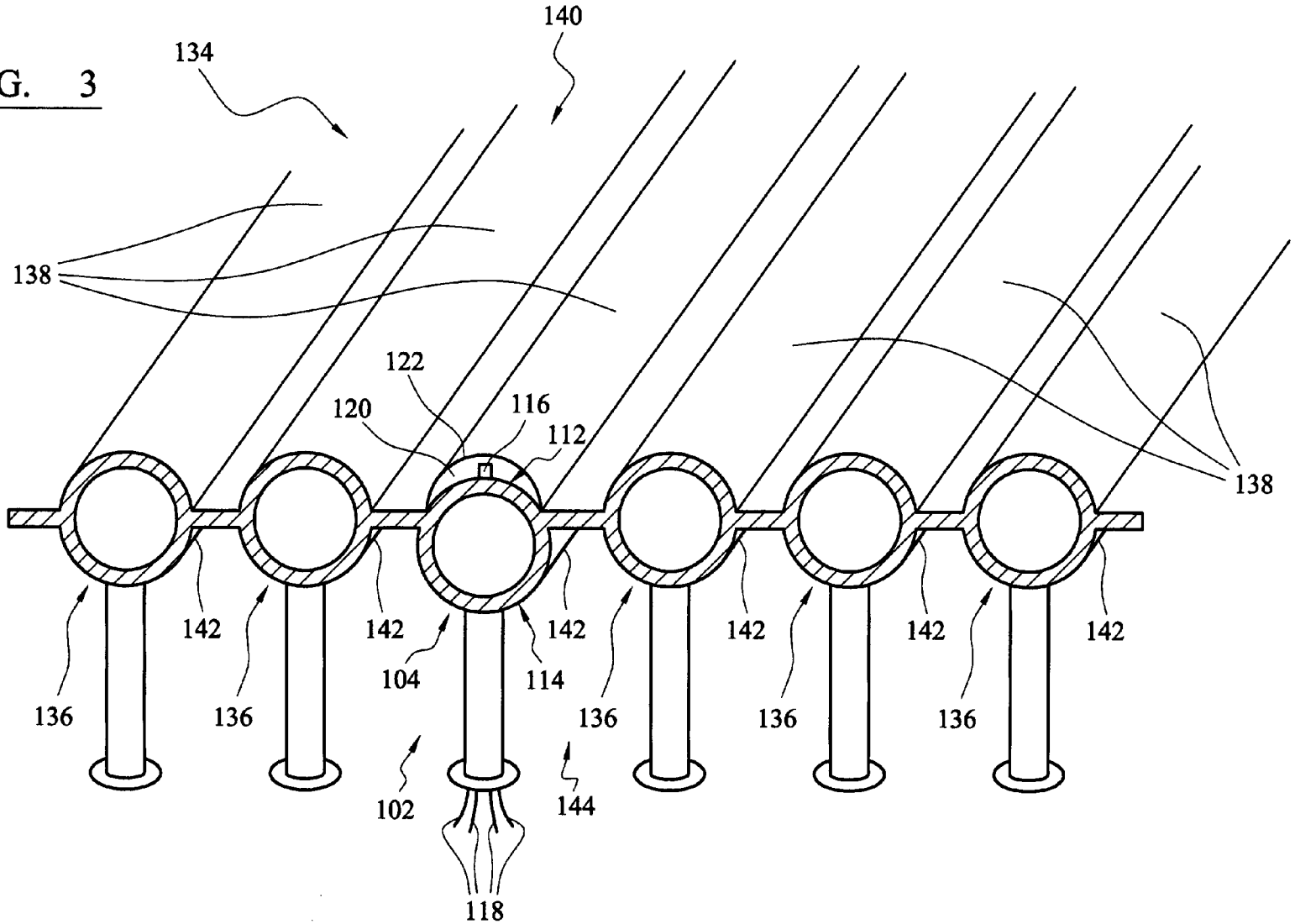
FIG. 3 shows a cross sectional perspective view of a number of pipe assemblies.

Referring now to FIG. 3 there is shown a cross section though a part of a wall 134 made from a number of pipes 136 and including a pipe assembly 102. The pipe assembly 102 is joined to the other pipes 136 by welding the ribs 130 to other pipes 136. The pipes 136 are similarly joined to each other by welding to either edge of a rib. The wall 134 forms part of an exterior wall of a combustion chamber (for example, a furnace or boiler) in a power station. Each pipe 136, 104 has an upper side 138 which forms part of an internal surface 140 of the wall 134 of the combustion chamber and is thus in fluid communication with the interior of the combustion chamber. Each pipe also has a lower side 142 which forms part of an external surface 144 of the wall 134 of the combustion chamber and is thus not in fluid communication with the interior of the combustion chamber.

In use, supercritical water/steam (not shown) is passed through internal bores of the pipes 136, 104. Heat from the combustion chamber conducts through walls of the pipes 136, 104 and heats the supercritical water/steam which results in an increase in pressure within the pipes 136, 104. The pressurised supercritical water/steam is used to drive a turbine (not shown) which drives a generator (not shown) and thus generates electricity in a well known manner.

As described above, it is important that a power station is efficiently run and in this regard the internal surface 140 of the wall 134 needs to be regularly cleaned to remove any build up of soot which occurs from the combustion of fossil fuels within the combustion chamber. However, performing the cleaning routine leads to a temporary reduction in heat transfer (and hence a drop in output because less steam is being produced) due to the cooling nature of the cleaning process.

In the present system the thermocouples 116 are able to detect the heat transfer through the pipe wall and send a signal through the wires 118 to a remote monitoring system such as a computer (not shown). This allows a user to monitor soot build up and choose an optimum time to perform the cleaning routine in order to minimize the drop in steam production.

Furthermore, the pipe assembly of the present invention provides a system which does not suffer a reduction in water/steam flow that prior art pipe assemblies suffer because the internal bore of the pipe is constant throughout the heat sensing region 110.

Therefore, a pipe assembly made in accordance with the present invention provides an efficient way to monitor the heat transfer through a boiler pipe and thus monitor the build up of soot on the surface of a pipe without suffering the adverse consequences observed when the flow of supercritical water/steam through the pipe is restricted.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A pipe assembly for use in a boiler, the pipe assembly comprising a pipe having an outer wall adapted for heat exchange, the pipe having heat sensing means located in a recess section of the outer wall thereof, wherein an internal bore of the pipe has a substantially constant cross section in the region of the heat sensing means, wherein the pipe comprises an offset portion, along a longitudinal axis of the pipe in the region of the heat sensing means, defined by a concave area along an external portion of one side of the pipe and a corresponding convex area along an external portion of a diametrically opposite side of the pipe and substantially parallel to the concave area.

2. A pipe assembly according to claim 1, wherein the pipe comprises a diagnostic portion.

3. A pipe assembly according to claim 2, wherein the diagnostic portion incorporates the recess in the outer wall of the pipe and the heat sensing means.

4. A pipe assembly according to claim 2, wherein the diagnostic portion is located at said offset portion.

5. A pipe assembly according to claim 2, wherein at the diagnostic portion, a longitudinal axis of the internal bore curves away from a generally straight longitudinal axis, before curving back to resume its original straight longitudinal axis.

6. A pipe assembly according to claim 2, wherein the pipe comprises a pre-diagnostic portion situated at a first side of the diagnostic portion and a post-diagnostic portion situated at a second side of the diagnostic portion.

7. A pipe assembly according to claim 6, wherein the longitudinal axis of the internal bore at the pre-diagnostic portion and the post-diagnostic portion are substantially colinear.

8. A pipe assembly according to claim 6, wherein an S region of the heat sensing means incorporates the pre-diagnostic portion, the diagnostic portion and the post-diagnostic portion.

9. A pipe assembly according to claim 1, wherein the recess section is filled using a filler material.

10. A pipe assembly according to claim 9, wherein the recess section is filled such that the outer surface is restored to match an outer profile of the rest of the pipe surrounding the recess section.

11. A pipe assembly according to claim 1, wherein the internal bore is substantially circular in cross section.

12. A pipe assembly according to claim 1, wherein the internal bore is adapted to allow a fluid to flow therethrough.

13. A pipe assembly according to claim 1, wherein the pipe assembly further comprises joining means adapted to allow the pipe assembly to be joined to other pipe assemblies.

14. A pipe assembly according to claim 13, wherein the joining means comprise at least one joining rib.

15. A pipe assembly according to claim 1, wherein the heat sensing means comprises at least one thermocouple.

16. A pipe assembly according to claim 1, which further comprises attachment means adapted to allow the pipe assembly to be attached to a surface.

17. The pipe assembly according to claim 1, wherein the internal bore of the pipe has a substantially constant cross section, along the longitudinal axis of the pipe, within the offset portion.

18. The pipe assembly according to claim 1, wherein the offset portion comprises a kinked portion.

19. A method of monitoring heat transfer across a heat exchange surface of a pipe assembly, the method comprising the step of:

monitoring an output from heat sensing means which heat sensing means are located in a recess section of an outer wall of a pipe, the pipe comprising an internal bore extending therethrough, wherein the internal bore has a substantially constant cross section in the region of the heat sensing means, wherein the pipe comprises an offset portion, along a longitudinal axis of the pipe in the region of the heat sensing means, defined by a concave area along an external portion of one side of the pipe and a corresponding convex area along an external portion of a diametrically opposite side of the pipe and substantially parallel to the concave area.

20. A method of manufacturing a pipe assembly comprising the steps of:

i) bending a pipe having an internal bore extending therethrough to create a recess section in an outer wall thereof, while maintaining a substantially constant cross section of the internal bore;

ii) locating heat sensing means in the recess section; and iii) using a filler material to fill the recess section, wherein bending the pipe comprises creating an offset portion, along a longitudinal axis of the pipe, in the region of the heat sensing means, the offset portion being defined by a concave area along an external portion of one side of the pipe and a corresponding convex area along an external portion of a diametrically opposite side of the pipe and substantially parallel to the concave area.

21. A diagnostic boiler pipe assembly, the assembly comprising a pipe having an outer wall adapted for heat exchange, the pipe having heat sensing means located in a recess section of the outer wall thereof, wherein an internal bore of the pipe has a substantially constant cross section in the region of the heat sensing means, wherein the pipe comprises an offset portion, along a longitudinal axis of the pipe, in the region of the heat sensing means, the offset portion being defined by a concave area along an external portion of one side of the pipe and a corresponding convex area along an external portion of a diametrically opposite side of the pipe and substantially parallel to the concave area.

22. A boiler comprising a pipe assembly, which pipe assembly comprises a pipe having an outer wall adapted for heat exchange, the pipe having heat sensing means located in a recess section of the outer wall thereof, wherein an internal bore of the pipe has a substantially constant cross section in the region of the heat sensing means, wherein the pipe comprises an offset portion, along a longitudinal axis of the pipe, in the region of the heat sensing means, the offset portion being defined by a concave area along an external portion of one side of the pipe and a corresponding convex area along an external portion of a diametrically opposite side of the pipe and substantially parallel to the concave area.

* * * * *

UNITED STATES PATENT AND TRADEMARK OFFICE

CERTIFICATE OF CORRECTION

PATENT NO. : 8,671,890 B2
APPLICATION NO. : 11/912720
DATED : March 18, 2014
INVENTOR(S) : Ian S. Davidson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1446 days.

Signed and Sealed this
Twenty-ninth Day of September, 2015

Michelle K. Lee

Michelle K. Lee
*Director of the United States Patent and Trademark Office*